US007558395B2

(12) United States Patent
De Haan

(10) Patent No.: US 7,558,395 B2
(45) **Date of Patent: *Jul. 7, 2009**

(54) LOUDSPEAKER

(75) Inventor: Philip Derek Eduard De Haan, Amsterdam (NL)

(73) Assignee: Alcons Audio B.V., Zwaag (NL)

( * ) Notice: Subject to any disclaimer, the term of this patent is extended or adjusted under 35 U.S.C. 154(b) by 314 days.

This patent is subject to a terminal disclaimer.

(21) Appl. No.: 10/547,634

(22) PCT Filed: Mar. 3, 2004

(86) PCT No.: PCT/NL2004/000159

§ 371 (c)(1),
(2), (4) Date: Jun. 12, 2006

(87) PCT Pub. No.: WO2004/080119

PCT Pub. Date: Sep. 16, 2004

(65) Prior Publication Data

US 2006/0262955 A1 Nov. 23, 2006

(30) Foreign Application Priority Data

Mar. 3, 2003 (NL) ..... 1022819

(51) Int. Cl.
*H04R 1/20* (2006.01)

(52) U.S. Cl. ..... 381/338; 381/431; 381/339; 381/343

(58) Field of Classification Search ..... 381/338, 381/340, 350, 408, 431, 397, 152, 176, 337–343, 381/399
See application file for complete search history.

(56) References Cited

U.S. PATENT DOCUMENTS 4,264,789 A * 4/1981 Kaizu et al. ..... 381/408
4,273,968 A * 6/1981 Suyama ..... 381/421
4,723,296 A * 2/1988 Nieuwendijk et al. ..... 381/399

(Continued)

FOREIGN PATENT DOCUMENTS

JP S5291415 8/1977

(Continued)

*Primary Examiner*—Suhan Ni
*Assistant Examiner*—Ryan C Robinson
(74) *Attorney, Agent, or Firm*—The Webb Law Firm

(57) ABSTRACT

A loudspeaker comprising a housing provided with a magnet unit that generates a magnetic field and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting the membrane in motion so as to produce sound, wherein the conductor pattern is provided on the membrane in at least two spaced-apart vibrating regions, wherein the loudspeaker is provided with at least two sound channels extending between the two vibrating regions and the outer side of the housing, and wherein the central axes of the two sound channels, which are located between the outer wall and the inner wall of each channel, incline towards each other over a particular distance from the membrane.

7 Claims, 2 Drawing Sheets

U.S. PATENT DOCUMENTS 5,117,462 A * 5/1992 Bie ..... 381/343
5,901,235 A * 5/1999 Thigpen et al. ..... 381/431
7,020,301 B2 * 3/2006 Koura et al. ..... 381/421
7,095,868 B2 * 8/2006 Geddes ..... 381/343
7,149,321 B2 * 12/2006 Hutt et al. ..... 381/389
7,174,024 B1 * 2/2007 Suzuki et al. ..... 381/152

FOREIGN PATENT DOCUMENTS

JP S5452232 10/1977
JP S5469822 5/1979
WO WO 98/20703 5/1998

* cited by examiner

LOUDSPEAKER

BACKGROUND OF THE INVENTION

The invention relates to a loudspeaker comprising a housing provided with a magnet unit that generates a magnetic field, and a membrane which is mounted in a frame and which is provided with an electrical conductor arranged in a pattern on the membrane, which membrane is positioned in the magnetic field in such a manner that a force is exerted when current is fed through the conductor pattern on the membrane, which force is capable of setting the membrane in motion so as to produce sound, said conductor pattern being provided on the membrane in at least two spaced-apart vibrating regions, the loudspeaker being provided with at least two sound channels extending between the two vibrating regions and the outer side of the housing.

Such a loudspeaker is described in U.S. patent publication No. 4,264,789. The sound channels transmit the sound that is produced by the two separate vibrating regions between the magnets to the environment. Such multiple sound sources have this drawback that delay time differences between the sound from each of the two sources are created, resulting in different arrival times at a particular position in the room. This leads to undesirable interference, causing the sound to be either amplified or at least partially attenuated, depending on the frequency and on the position of the listener. This phenomenon is also referred to as "lobing".

SUMMARY OF THE INVENTION

The object of the invention is to provide a loudspeaker of the kind referred to in the introduction, which reduces the above-described effect in a simple and efficient manner and/or which exhibits improved mechanical and/or acoustic properties in comparison with known loudspeakers.

To that end, the central axes of the two sound channels, which are located between the outer wall and the inner wall of each channel, incline towards each other over a particular distance from the membrane. The central axis of a sound channel is understood to be the imaginary centre plane located precisely between the inner wall and the outer wall of the channel. In this way, the wavefronts of the two sound sources are gradually guided towards each other, being combined upon exiting the sound channels. Subsequently, the one combined wave front can widen in the environment. The aforesaid lobing effect is largely prevented in this manner. Preferably, the outer walls of the two sound channels that are positioned furthest away from each other incline towards each other over a particular distance from the membrane and, likewise preferably, the inner walls of the two sound channels that are positioned closest to each other likewise incline towards each other over at least a particular distance from the membrane. Even more preferably, the inner wall and the outer wall of each sound channel extend substantially parallel to each other.

The distance over which the walls incline towards each other is preferably at least 0.5 time, preferably at least 1 time, the width of the sound channels. The distance between the inner walls of the sound channels on the outer side of the housing is furthermore preferably less than 0.5 time, preferably less than 0.2 time, the distance between the inner walls on the side of the membrane. This achieves that the two wave fronts are combined as gradually as possible.

Preferably, the outer walls of the sound channels join the diverging walls of a sound horn near their ends, as a result of which the combined front initially widens in a controlled and, in addition, directed manner.

BRIEF DESCRIPTION OF THE DRAWINGS

The invention will now be explained in more detail by means of an embodiment as shown in the figures, in which.

DETAILED DESCRIPTION OF THE INVENTION

Figure 1:
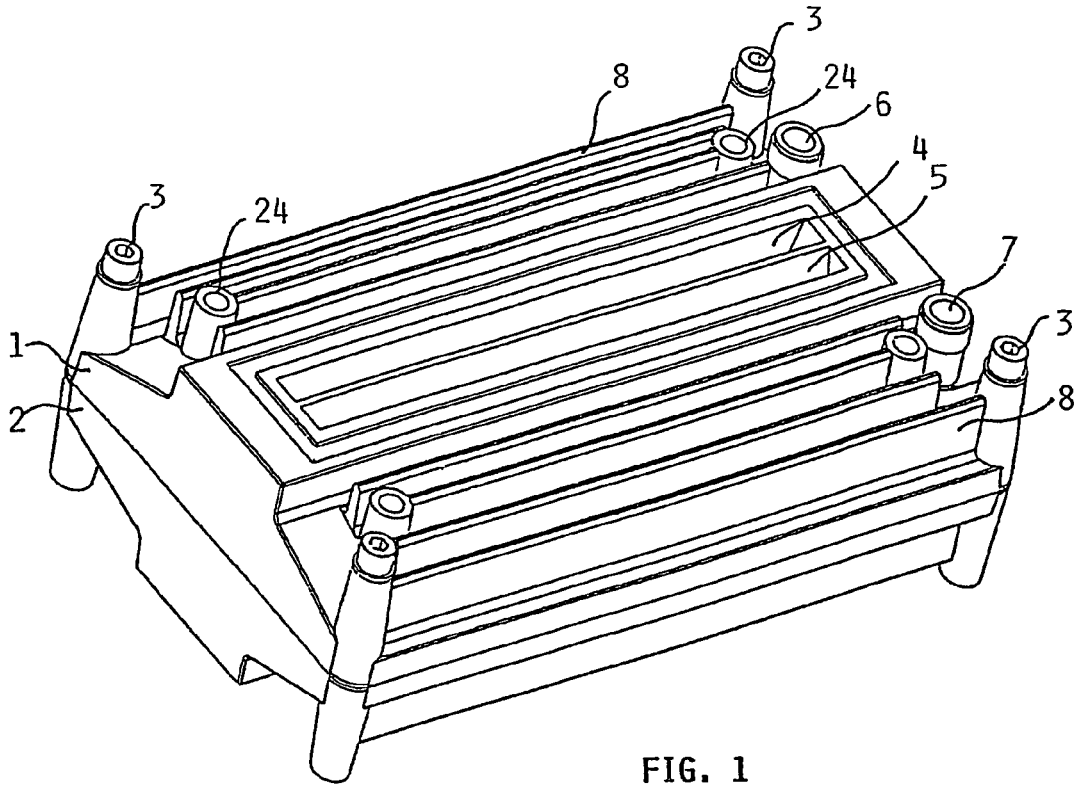
FIG. 1 is a partial perspective view of a loudspeaker.

According to FIG. 1, a loudspeaker comprises a housing which consists of two substantially identical metal parts 1, 2, which are mounted together by means of screws 3. Each housing part 1, 2 has two elongate slot-shaped recesses or sound channels 4, 5, which enable the sound that is generated in the loudspeaker to propagate towards the outside. Furthermore, a housing part 1 is provided with electrical connecting points 6, 7, to which the sound signal wires of an amplifier can be connected. The housing 1, 2 is provided with cooling fins 8 for dissipating the heat that is generated in the loudspeaker.

Figure 2:
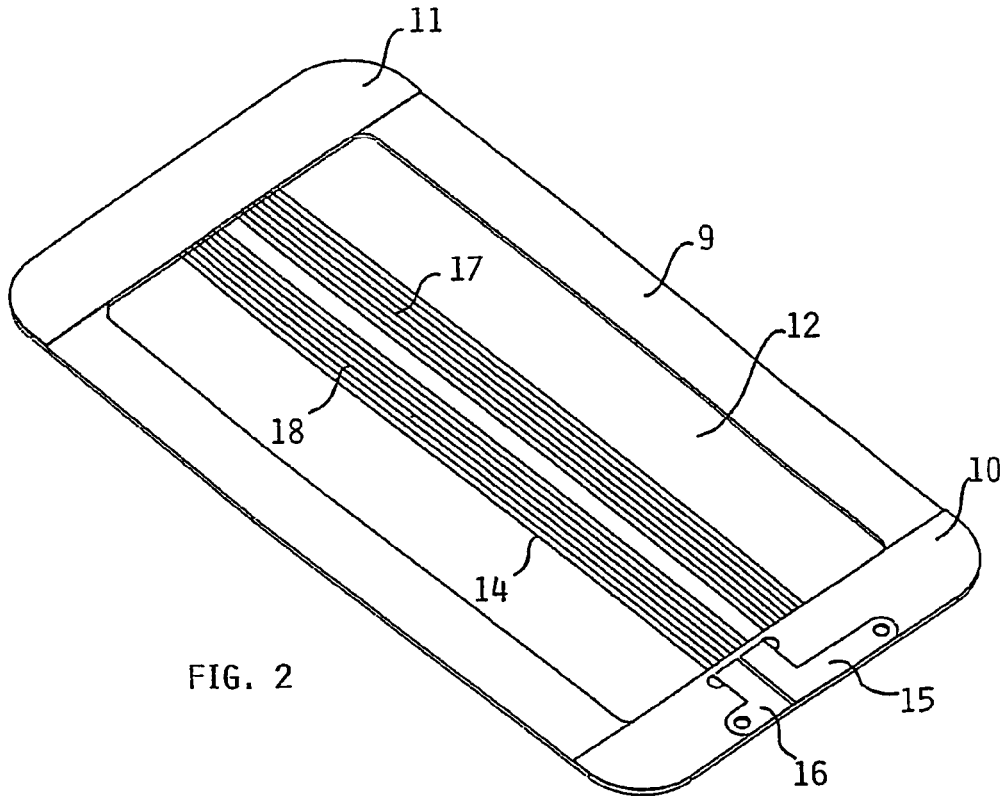
FIG. 2 is a perspective view of a membrane unit.
Figure 4:
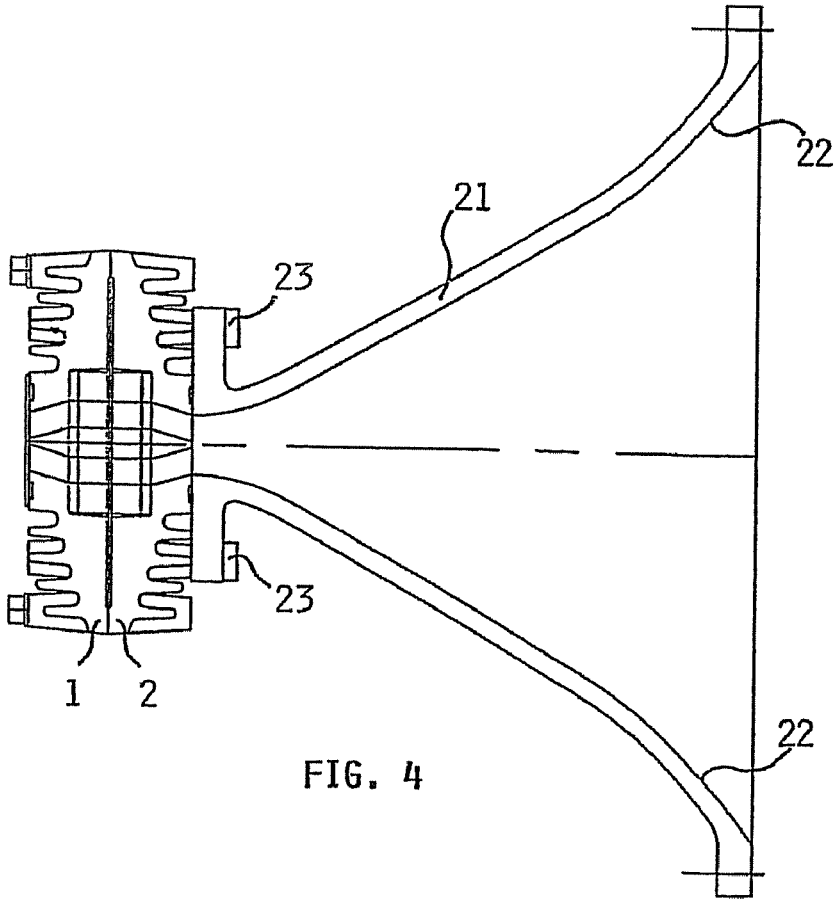
FIG. 4 is a cross-sectional view of the loudspeaker of FIG. 1, on which a sound horn is mounted.

The housing parts 1, 2 enclose a frame that is shown in FIG. 2, which consists of a first, frame-shaped frame member 9 and two strip-shaped frame members 10, 11 (shown in FIG. 4). The frame members 9, 10, 11 are preferably made of copper or anodised aluminium. The outer surface of the frame members 9, 10, 11 makes contact with the housing 1, 2 all around. A vibrating membrane 12 is affixed to the frame member 9 by means of a glue, or by means of a thin, double-coated adhesive tape. The glue or the tape is of a heat-conducting type. The membrane 12 is provided with an electric conductor pattern 14, which is connected to the connecting points 6, 7 and which causes the membrane to vibrate when an electrical signal is supplied to the loudspeaker by the amplifier.

Figure 3:
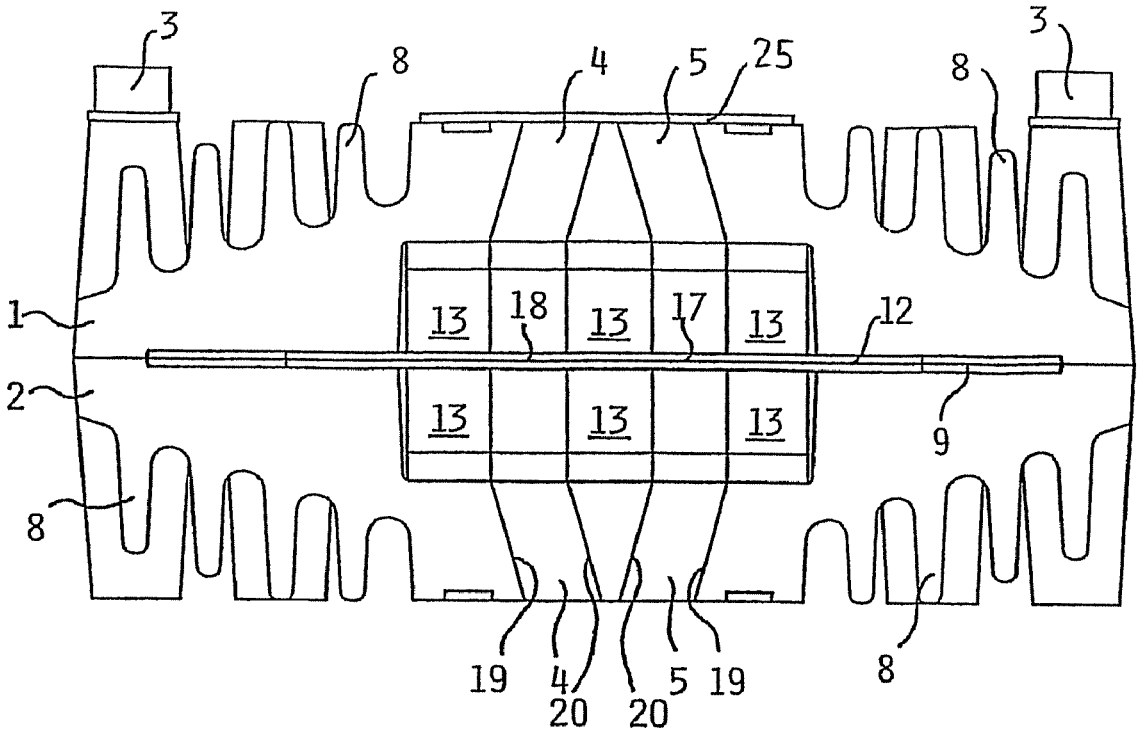
FIG. 3 is a cross-sectional view of the loudspeaker of FIG. 1.

To that end the loudspeaker comprises magnets 13 as shown in FIG. 3, which generate a permanent magnetic field within which the conductor pattern 14 of the membrane 12 is located. The conductor pattern 14 is formed by an electrically conducting wire arranged in an elongate, rectangular spiral on one side of the membrane 12. On the short sides of the rectangular pattern, the frame members 10, 11 are mounted directly on the conductor pattern. The glue or the tape by means of which said frame members are affixed to the conducting wire must be electrically insulating, therefore. On the other side of the membrane 12, said short sides of the pattern are likewise covered, in this case by the short sides of the frame-shaped frame member 9. In this way the conductor pattern 14 is capable of transferring heat to the frame members 9, 10, 11 in two directions.

The two ends of the conducting wire are connected to current feed-through connections 15, 16 on the frame member 10, which are in turn electrically connected to the connecting points 6, 7. The current feed-through connections 15, 16 are electrically insulated from the frame member 10. The lines of the conductor pattern 14 that extend parallel to each other in the longitudinal direction between the frame members 10, 11 form two spaced-apart vibrating regions 17, 18.

Referring to FIG. 3, the sound channels 4, 5 extend from a point located near the two spaced-apart vibrating regions 17, 18 on the surface of the membrane 12 to the outer side of the housing parts 1, 2; on one side the sound channels 4, 5 are closed by a closing plate 25, however, because the loudspeaker must emit the sound in only one direction. The sound channels 4, 5 initially extend in a direction perpendicularly to the membrane, seen from the membrane, viz. in the region between the magnets 13, and subsequently the sound channels 4,5 incline towards each other. Both the outer walls 19 and the inner walls 20 of each sound channel 4, 5 incline towards each other, with the inner wall 20 and the outer wall 19 of a sound channels 4, 5 continuing to extend parallel to each other. On the outer side of the loudspeaker, only a small spacing remains between the inner walls 20 of the two sound channels 4, 5, which spacing is at least several times smaller than the spacing between the vibrating regions 17, 18. In this way the fronts of the sound waves that are generated by the two vibrating regions 17, 18 are directed towards each other and combined, so that disadvantageous interference between the two wavefronts is prevented.

FIG. 4 shows a sound horn 21 which is mounted in screw holes 24 of the loudspeaker by means of screws 23. The outer walls 19 of the sound channels 4, 5 join the walls 22 of the sound horn 21. The sound horn 21 provides a gradual widening of the sound front that exits the sound channels 4, 5 before said sound front widens further in the environment. The horn, which is made of a metal, furthermore contributes to the heat dissipation of the loudspeaker.

The invention claimed is:

1. A loudspeaker comprising a housing provided with a magnet unit that generates a magnetic field and a flexible membrane which is mounted in a frame and which is provided with an electrical conductor arranged in a pattern on a central part of the membrane, which membrane is positioned in the magnetic field in such a manner that a force is exerted when current is fed through the conductor pattern on the membrane, which force is capable of setting the membrane in motion so as to produce sound, said conductor pattern being provided on the membrane in at least two spaced-apart vibrating regions, the loudspeaker being provided with at least two sound channels each extending between one of said electrical conductor patterns in each of the vibrating regions and the outer side of the housing, wherein the central axes of the at least two sound channels, which are located between the outer wall and the inner wall of each channel, incline towards each other over a particular distance from the membrane.

2. The loudspeaker according to claim 1, wherein the outer walls of the two sound channels that are positioned furthest away from each other incline towards each other over a particular distance from the membrane.

3. The loudspeaker according to claim 1, wherein the inner walls of the two sound channels that are positioned closest to each other incline towards each other over at least a particular distance from the membrane.

4. The loudspeaker according to claim 1, wherein the inner wall and the outer wall of each sound channel extend substantially parallel to each other.

5. The loudspeaker according to claim 1, wherein the particular distance is at least 0.5 times, preferably at least 1 times, the width of the sound channels.

6. The loudspeaker according to claim 1, wherein the distance between the inner walls of the sound channels on the outer side of the housing is less than 0.5 times, preferably less than 0.2 times, the distance between the inner walls on the side of the membrane.

7. The loudspeaker according to claim 1, wherein the outer walls of the sound channels join the diverging walls of a sound horn near their ends.

* * * * *